United States Patent [19]

Helm

[11] Patent Number: 4,942,638

[45] Date of Patent: Jul. 24, 1990

[54] HAND-GUIDED, MOBILE CLEANING MACHINE

[75] Inventor: Kurt Helm, Nahe, Fed. Rep. of Germany

[73] Assignee: Hako-Werke GmbH & Co., Bad Oldesloe, Fed. Rep. of Germany

[21] Appl. No.: 285,046

[22] Filed: Dec. 15, 1988

[30] Foreign Application Priority Data

Dec. 16, 1987 [DE] Fed. Rep. of Germany ..... 3742648

[51] Int. Cl.[5] ..... A47L 11/16; A47L 11/40

[52] U.S. Cl. ..... 15/50 R; 15/49 R; 15/320; 180/19.2

[58] Field of Search ..... 15/49 R, 49 C, 50 R, 15/50 C, 50 A, 51, 52, 98, 320, 340.2, 340.3, 340.4, 385; 180/19.2, 19.3, 6.2

[56] References Cited

U.S. PATENT DOCUMENTS

| | | | |
|---|---|---|---|
| 3,190,386 | 6/1965 | Swinny | 180/19.2 |
| 4,158,901 | 6/1979 | Wulff et al. | 15/50 R X |
| 4,339,841 | 7/1982 | Waldhauser et al. | 15/98 |
| 4,763,741 | 8/1988 | Torta | 15/50 R X |

*Primary Examiner*—Edward L. Roberts

*Attorney, Agent, or Firm*—Foley & Lardner

[57] ABSTRACT

A hand-guided mobile cleaning machine particularly a scrubbing machine having a cleaning tool positioned between a rear roller drive assembly and a front roller steering assembly, the steering assembly being operated by a handle-bar mounted on the rear of the machine, the handle-bar being operatively coupled to the steering assembly by either a set of Bowden cables, a sprocket and chain arrangement, or a motor driven gear arrangement.

13 Claims, 4 Drawing Sheets

HAND-GUIDED, MOBILE CLEANING MACHINE

BACKGROUND OF THE INVENTION

1. Field of the Invention

The present invention relates to a hand-guided, mobile cleaning machine, particularly a scrubbing machine, having a cleaning tool which is positioned to engage the ground and is attached between a rear set of drive rollers and a front steering roller assembly that can be controlled by a handle-bar located at the rear of the machine.

2. Description of the Prior Art

In general, cleaning machines of the type having a front set of drive rollers and/or rear roller or rollers which are freely rotatable on a vertical axis for steering the machine are well known. In use, the cleaning machine is "pulled" by the front drive rollers while the operator steers the machine by putting pressure on the rear roller or rollers by the application of lateral force on a handle-bar such that the roller or rollers pivot on their vertical axis thus causing a steering effect.

This type of construction has the disadvantage that on the one hand relatively great force has to be applied by the operator for the steering the machine, and on the other hand, the machine requires a large turning circle, which makes it particularly difficult to bring the cleaning machine up to walls and the like and to move it away from them.

In mobile cleaning machines in which the operator rides on the cleaning machine, in other words for very large cleaning machines such as disclosed in U.S. Pat. No. 3,879,789 issued on Apr. 29, 1975 and entitled "Scrubbing Machine", a front steering roller is used to steer the machine. This type of machine is relatively expensive, unwieldly and limited to large surface application.

SUMMARY OF THE INVENTION

In accordance with one aspect of the present invention, a hand-guided mobile cleaning machine is provided for a small surface applications which is simply designed and can be easily handled and guided accurately from the rear of the machine. This has been achieved in a cleaning machine constructed according to the invention such that the rear set of rollers is driven and the front roller assembly can be quickly and easily adjusted by an operator located at the rear of the machine.

In the cleaning machine, according to the invention, steering is carried out by a controlled adjustment of the alignment of the roller assembly which is carried out by the operator at the rear of the machine, and results in a more easily controlled and accurate steering of the machine along walls, shelves and the like, as well as for driving around obstacles.

In a cleaning machine wherein the rear set of rollers is driven, the cleaning machine can be driven without great difficultly up relatively steep slopes because the greatest part of the weight of the machine is resting on the driven rollers whereby they are pressed into firm engagement with the ground so that the required driving forces are easily transferred.

Control of the position of the front roller steering assembly is achieved by mechanically coupling the front roller steering assembly to a generally horizontally disposed handle-bar at the rear of the machine which can be quickly and easily manipulated by the operator.

DESCRIPTION OF THE DRAWINGS

A preferred exemplary embodiment will hereinafter be described in conjunction with the appended drawings wherein like numbers denote like elements and.

In some of the figures, elements are omitted or shown only in schematic form for ease of illustration and clarity.

DETAILED DESCRIPTION OF A PREFERRED EXEMPLARY EMBODIMENT

Figure 1:
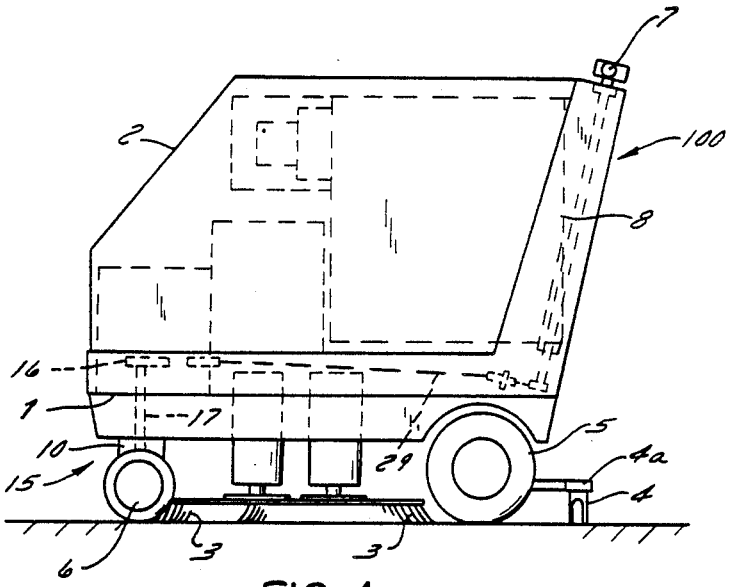
FIG. 1 is a side view of a cleaning machine in the form of a scrubbing machine according to the invention.
Figure 2:
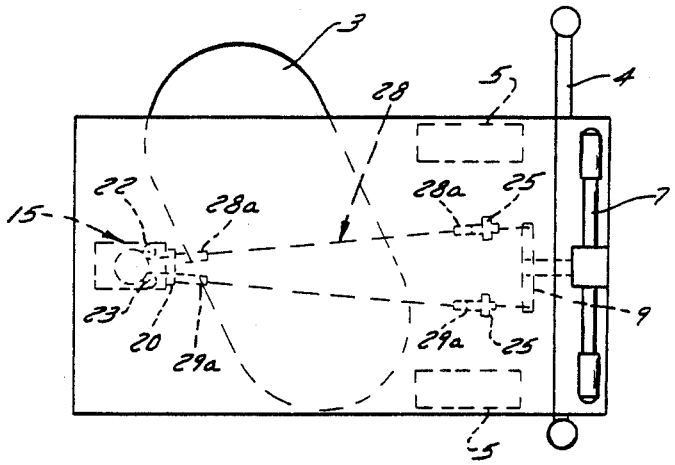
FIG. 2 is a top view of the cleaning machine shown in FIG. 1 with some of the parts indicated in phantom lines.
Figure 3:
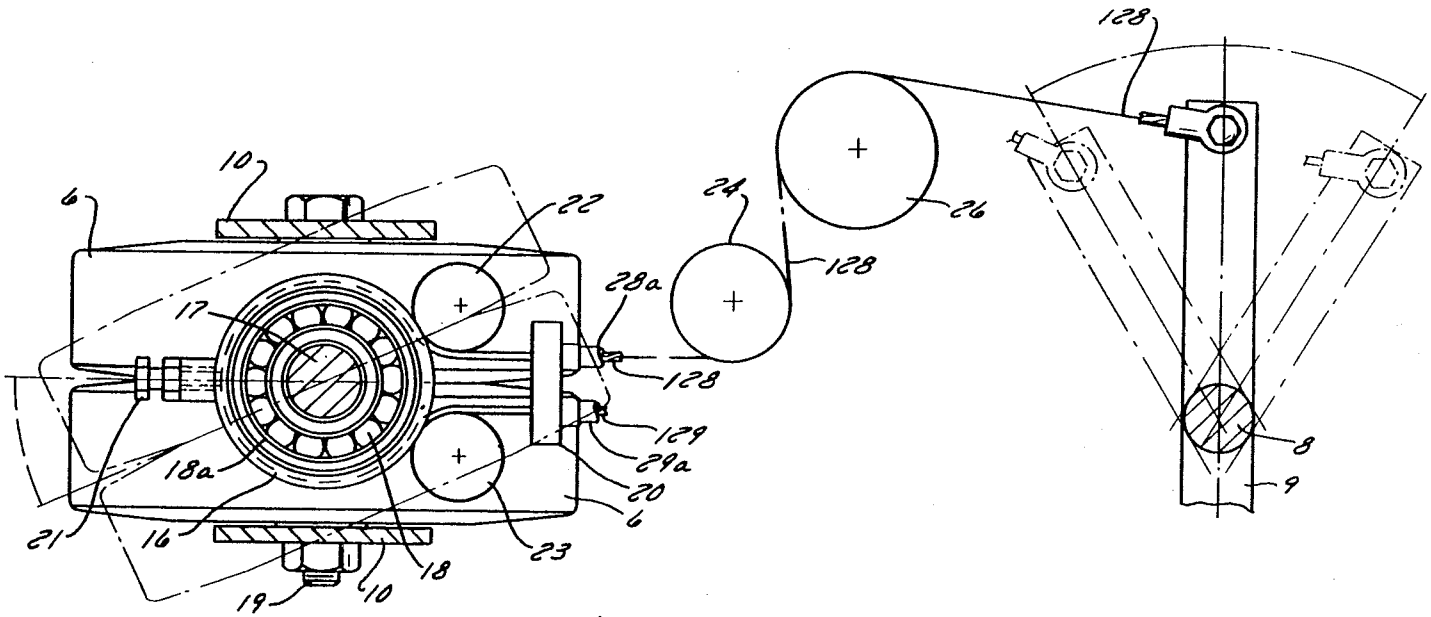
FIG. 3 is a schematic view of a Bowden cable arrangement for controlling the front roller steering assembly.

Referring now to FIGS. 1, 2, and 3, a handguided cleaning machine 100 is shown which includes a machine frame 1 on which is arranged a casing 2 for enclosing the usual components, shown in phantom, for a scrubbing machine. Mounted on the machine frame 1 are two rear rollers 5 and a front roller steering assembly 15. The steering assembly 15 includes a steering roller 6 which can be pivoted about a vertical axis in the center plane of the scrubbing machine 100. The rear rollers 5 are coupled with the scrubbing machine drive device such as a battery-operated electromotor in a conventional manner.

In the scrubbing machine 100, as described, a pair of scrubbing brushes 3 are positioned between the rear drive rollers 5 and the steering assembly 15. Cleaning fluid is supplied to the brushes 3 in a conventional manner when the machine is in operation. The cleaning fluid applied to the floor is taken up behind the rollers 5, also in a usual manner, by a squeegee 4 supported on the frame by a bracket 4*a*.

The scrubbing machine 100 is guided by the steering assembly 15 which is connected to a handle-bar 7 provided at the rear of the machine 100. The handle-bar 7 is mounted above the casing 2 on the upper end of a rotatably mounted axle 8 which extends downward into the casing 2. A steering lever 9 is secured to the lower end of the rotatably mounted axle 8 and extends parallel to the handle-bar 7.

As shown schematically in FIGS. 2 and 3, the steering lever 9 is connected to the steering assembly 15 by Bowden cables 28 and 29. The Bowden cables 28 and 29 include a sheath 28*a*, 29*a* and a cable 128 and 129. The sheaths 28*a* and 29*a* are connected to abutment 20 at one end and to abutment 25 at the other end. As shown in FIG. 3, the cable wire 128 of cable 28 is connected to lever 9 at one end and is wound around guide rollers 24 and 26. The other end of cable wire 128, as well as cable 129, pass through abutment 20 around guide rollers 22 and 23, respectively, and part way around sheave 16.

The ends of the cable wires 128 and 129 are fastened to the front of sheave 16 by means of a clamp 21.

The cable sheave 16 is mounted on the outer ring 18a of a bearing 18 which is mounted on a vertical axle 17 on the frame 1. The steering assembly 15 is secured to sheave 16 so that rotary motion of the sheave 16 will produce a corresponding motion in steering assembly 15. In this regard, roller assembly 15 includes a pair of fastening braces 10 which are secured to the sheave 16 by a plate (not shown). A pair of steering rollers 6 are supported on the fastening braces 10 by means of an axle 19. Although a pair of rollers 6 are shown herein, a single roller can also be used. Steering of the machine is accomplished by rotating the handle-bar 7 about the axis of axle 8 which produces a corresponding motion in roller assembly 15.

When the machine is in operation, the rollers 6 rotate about the axle 19 which is held by the two fastening braces 10 mounted on the bearing. As shown extracted in FIG. 3, if the handle-bar 7 is in an exact perpendicular relation to the longitudinal axis of the scrubbing machine then the steering lever 9 is also in this position and the roller 6 is pointed towards the middle axle of the scrubbing machine. In other words, the machine is being driven in a straight line. To steer, the operator moves the handle-bar 7 in the direction wanted, whereby the axle 8 and the lever 9 are also correspondingly turned, e.g., one of the positions shown in a dotted line in FIG. 3. At the same time, one of the wires 128 or 129 of the Bowden cables 28, 29 exerts a corresponding pulling force on the Bowden wire fastened to it and thus the cable sheave 16 and, therefore, the steering assembly 15 is turned about the axle 17, to a position as indicated in a dotted line in FIG. 3. At the same time the tension wire of the other Bowden cable is drawn through the sheathing, there results from the corresponding displacement of the other end of the steering lever, and thus does not hinder the rotating movement of the steering assembly 15.

Figure 4:
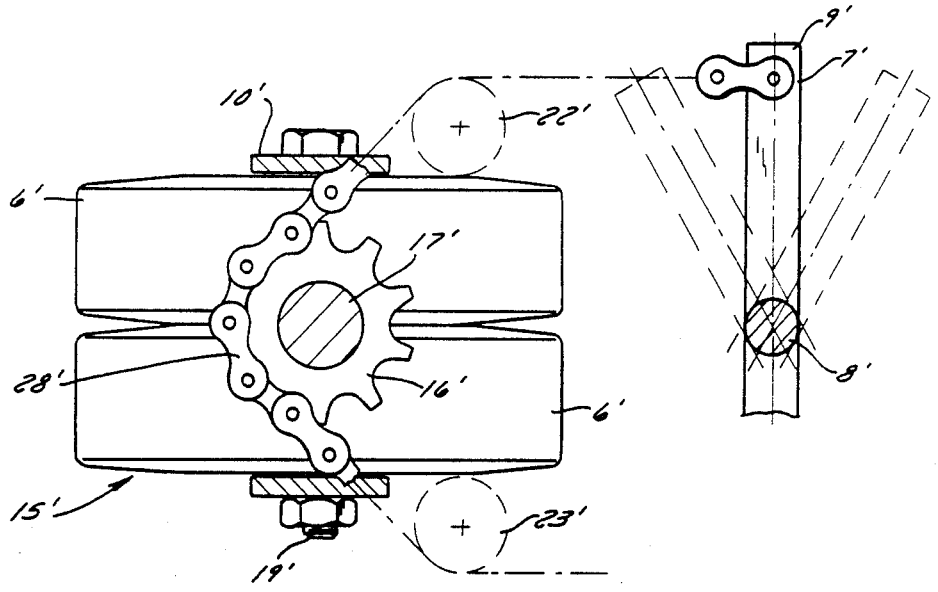
FIG. 4 is a schematic of an alternate form of control arrangement wherein a chain is used for positioning the front roller steerng assembly.

As shown in FIG. 4, a chain, instead of the Bowden cables 28 and 29, can be used to adjust the steering assembly 15. It should be noted that in FIG. 4, the same or corresponding parts from FIG. 3 are designated with the same referenced numbers and additionally marked with ′.

As can be seen, the vertical axle 17′ in this case supports a sprocket 16′ for rotary motion on the bearing (not shown). A chain 28′ is aligned with the sprocket 16′ and with idling sprocket wheels 22′, 23′ and fastened to the ends of the steering lever 9′.

If, therefore, the handle-bar 7′ of the scrubbing machine, which is not shown in FIG. 4, is moved, there follows a corresponding rotation of the axle 8′ and thereby a shifting movement of the steering lever 9′ in one of the directions shown by dotten lines in FIG. 4. This movement results in a corresponding shifting movement of the chain 28′, by which the gear 16′ and therefore the steering assembly 15′ is swivelled about the axle 17′.

Figure 6:
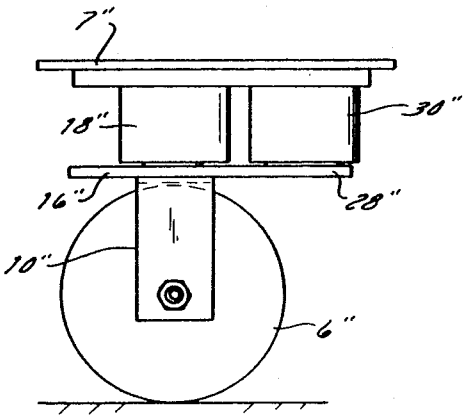
FIG. 6 is a side view of portion of the control arrangement shown in FIG. 5.
Figure 5:
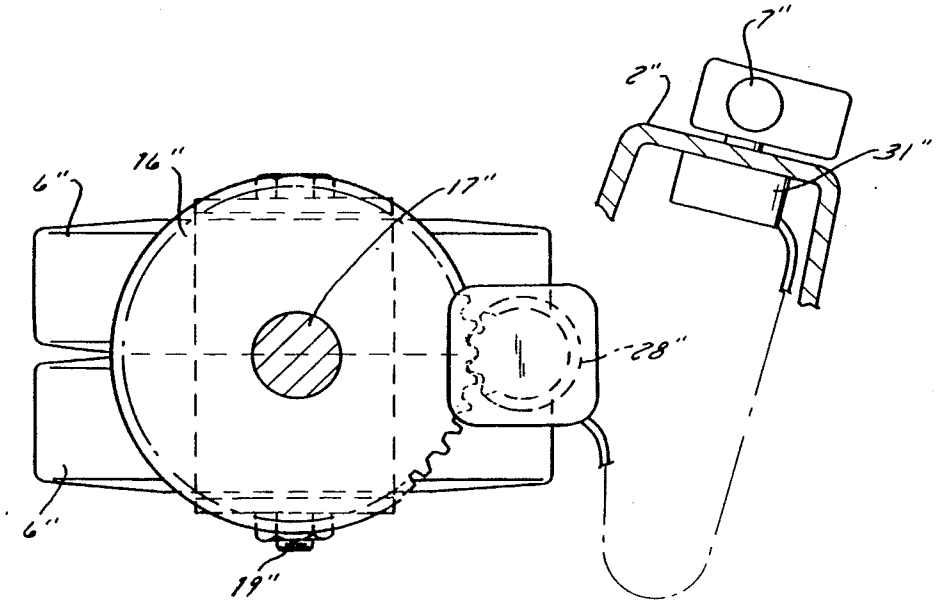
FIG. 5 is a schematic of another form of control arrangement wherein a servo-motor is used for positioning the front roller steering assembly.

In FIGS. 3 and 4, a purely mechanical coupling between the handle-bar and the front roller is shown. FIGS. 5 and 6 show an arrangement employing an electrical coupling in which the same components as in FIG. 3, or parts corresponding to the components in FIG. 3, are given the same reference numbers and additionally marked with ″.

As shown, the steering assembly 15″ includes two rollers 11 which are mounted on the axle 19″, which is fastened by means of two fastening braces 10″ via a bearing arrangement 18″, shown in schematic form, to the machine frame 1″. The vertical axle 17″ is mounted for rotary motion in the bearing 18″ and connected at its lower end to a gear 16″ which meshes with a gear 28″ mounted on the output shaft of an electric servomotor 30″ (FIG. 6), which, in turn, is mounted on the machine frame 1. The servo-motor 30″ is connected via an electric cable 8″ with an electric control means 31″, shown in schematic form in FIG. 5, which, for example, can contain a potentiometer, the position of which is measured for the angle of the axle 17″ and, therefore, of the handle-bar 7″.

If the handle-bar 7″ is turned out of its position perpendicular to the longitudinal axis of the machine to bring about a steering effect, then the electric control means 31″ transmits the corresponding signal over the cable 8″ to the servo-motor 30, which by rotating its output shaft and therefore the gear 28″, causes a corresponding movement of the steering assembly 15″ via the gear 16″.

I claim:

1. A hand-guided, mobile cleaning machine comprising:

a frame;

a front roller assembly and a set of rear rollers each secured to the underside of the frame for movably supporting the machine;

means for driving the rear rollers;

a cleaning tool mounted on the frame for contact with the ground, the cleaning tool being disposed between the front roller assembly and rear rollers;

a handlebar mounted on the rear of the machine; and, means operatively connecting the handlebar to the front roller assembly for allowing the operator to control the direction of motion of the machine from the rear of the machine by manipulation of the handlebar which causes rotation of the front roller assembly.

2. The machine according to claim 1, wherein said connecting means includes a vertical axle secured to said frame at the front of the machine, a bearing mounted on said vertical axle, a sheave mounted for rotary motion on said bearing, said sheave being connected to the front roller steering assembly whereby pivotal movement of said sheave will pivot the front roller assembly about said axle, and means mounted on said sheave and connected to said handlebar for pivoting said sheave in response to movement of said handlebar.

3. The machine according to claim 2, wherein said sheave pivoting means comprises a pair of cables, each cable having one end secured to said sheave and disposed so that said cables are wound about opposite sides of said sheave, and means connected to the other end of each cable for causing pivotal movement of said handlebar to rotate said sheave and pivot the front roller assembly about said vertical axle to change the direction of motion of the machine.

4. The machine according to claim 3, wherein said means for causing pivotal movement of said handlebar to rotate said sheave further comprises a handlebar axle rotatably mounted on the machine, said handlebar being secured to an upper end portion of said handlebar axle, and a steering lever centrally secured to a lower end portion of said handlebar axle for unison rotation with said handlebar, said cables having ends thereof secured to opposite ends of said steering lever.

5. The machine according to claim 1, wherein said connecting means includes a vertical axle secured to the frame at the front of the machine, a sprocket mounted for rotary motion with respect to said axle, said sprocket being secured to the front roller assembly for unison rotation therewith, and means mounted on said sprocket and connected to said handlebar for rotating said sprocket in response to movement of said handlebar to change the direction of motion of the machine.

6. The machine according to claim 5, wherein said rotating means comprises a chain mounted on said sprocket and means connected to said chain for causing pivotal movement of said handlebar to rotate said sprocket and pivot the front roller assembly about said vertical axle to change the direction of motion of the machine.

7. The machine of claim 1, wherein said connecting means comprises a vertical axle on the front of the machine, a gear mounted on said vertical axle, said gear being connected to the front roller assembly, whereby pivotal movement of said gear will pivot the front roller assembly about said vertical axle, and gear drive means mounted on said gear and connected to said handlebar for rotating said gear in response to movement of said handlebar.

8. The machine according to claim 7, wherein said gear drive means includes a drive motor having a drive gear operatively positioned to drive said gear mounted on said front roller assembly, a potentiometer connected to said handlebar, and means for electrically connecting said potentiometer to said drive motor, whereby pivotal movement of said handlebar will activate said drive motor to rotate said gears and change the direction of motion of the machine.

9. The machine according to claim 1, wherein said front roller steering assembly is non-driven.

10. The machine according to claim 1, further comprising a casing secured to said frame, wherein said connecting means comprises an axle rotatably mounted in said casing, said handlebar being secured to an upper end portion of said axle, a steering lever within said casing centrally secured to a lower end portion of said axle for unison rotation with said handlebar, and means connected to opposite ends of said steering lever for rotating said front wheel assembly in response to rotation of said steering lever.

11. In a hand-guided, mobile cleaning machine, particularly a scrubbing machine having a cleaning tool which comes into contact with the ground, the cleaning tool being attached between a rear set of rollers and a front roller assembly mounted on the machine frame, such that the rear set of rollers is driven and the front roller steering assembly can be guided by the operator from the rear of the machine, the improvement comprising:

a handlebar mounted on the rear of the machine, and means operatively connecting said handlebar to the steering assembly whereby the operator can control the direction of motion of the machine from the rear of the machine, said means including a vertical axle on the front of the machine, a bearing mounted on said vertical axle and a sheave mounted for rotary motion on said bearing, said sheave being connected to the front roller steering assembly by a pair of Bowden cables, each Bowden cable having one end operatively connected to said handlebar and the other end to opposite sides of said sheave, whereby pivotal movement of said handlebar will rotate said sheave and pivot the front roller assembly about said vertical axle to change the direction of motion of the machine.

12. In a hand-guided, mobile cleaning machine, particularly a scrubbing machine having a cleaning tool which comes into contact with the ground, the cleaning tool being attached between a rear set of rollers and a front roller steering assembly mounted on the machine frame such that the rear set of rollers is driven and the front roller steering assembly can be guided by the operator from the rear of the machine, the improvement comprising:

a handlebar mounted on the rear of the machine, and means operatively connecting said handlebar to the steering assembly whereby the operator can control the direction of motion of the machine from the rear of the machine, said means including a vertical axle on the front of the machine, a sprocket mounted for rotary motion with respect to said axle, said sprocket being connected to the front roller steering assembly, and a chain operatively connected to said sprocket and said handlebar whereby pivotal movement of said handlebar will rotate said sprocket and pivot the roller assembly about said vertical axis to change the direction of motion of the machine.

13. In a hand-guided, mobile cleaning machine, particularly a scrubbing machine having a cleaning toll which comes into contact with the ground, the cleaning tool being attached between a rear set of rollers and a front roller steering assembly mounted on the machine frame such that the rear set of rollers is driven and the front roller steering assembly can be guided by the operator from the rear of the machine, the improvement comprising:

a handle bar mounted on the rear of the machine, and means operatively connecting said handlebar to the steering assembly whereby the operator can control the direction of motion of the machine from the rear of the machine, said means including a vertical axle on the front of the machine, a driven gear mounted on said vertical axle, said gear being connected to the front roller assembly, a drive motor having a drive gear operatively positioned to drive said driven gear, and a potentiometer connected to said handlebar and being electrically connected to said drive motor whereby pivotal movement of said handlebar will activate said drive motor to rotate said gear and pivot said roller assembly about said vertical axle to change the direction of motion of the machine.

* * * * *